US011850204B2

(12) United States Patent
Williams et al.

(10) Patent No.: US 11,850,204 B2
(45) Date of Patent: Dec. 26, 2023

(54) SYSTEM AND METHOD FOR LOCKING PERCUSSION SETTINGS ON A MASSAGE DEVICE

(71) Applicant: PlayMakar Inc., Fort Worth, TX (US)

(72) Inventors: Michael James Williams, Colleyville, TX (US); Federico G. Vierheller, Fort Worth, TX (US); Wesley A. Coleman, N. Richland Hills, TX (US)

(73) Assignee: PlayMakar, Inc., Fort Worth, TX (US)

( * ) Notice: Subject to any disclaimer, the term of this patent is extended or adjusted under 35 U.S.C. 154(b) by 0 days.

(21) Appl. No.: 17/740,143

(22) Filed: May 9, 2022

(65) Prior Publication Data

US 2023/0355464 A1 Nov. 9, 2023

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 2201/0188* (2013.01); *A61H 2201/149* (2013.01); *A61H 2201/1418* (2013.01); *A61H 2201/5025* (2013.01); *A61H 2201/5035* (2013.01); *A61H 2201/5046* (2013.01)

(58) Field of Classification Search
CPC ..... A61H 23/006; A61H 23/0254; A61H 2201/0188; A61H 2201/1418; A61H 2201/149; A61H 2201/5025; A61H 2201/5046
See application file for complete search history.

(56) References Cited

U.S. PATENT DOCUMENTS

| | | | |
|---|---|---|---|
| 859,424 | A | 7/1907 | Aschburner |
| 890,822 | A | 6/1908 | Tourtel et al. |
| 1,368,782 | A | 2/1921 | Beach |
| 2,122,556 | A | 7/1938 | Buffalow |
| 2,156,839 | A | 5/1939 | Buffalow |
| 4,088,128 | A | 5/1978 | Mabuchi |
| 4,513,737 | A | 4/1985 | Mabuchi |
| 4,549,535 | A | 10/1985 | Wing |
| D284,553 | S | 7/1986 | Collister |
| 4,726,430 | A | 2/1988 | Hendrikx et al. |
| 4,790,296 | A | 12/1988 | Segal |
| 4,841,955 | A | 6/1989 | Evans et al. |

(Continued)

FOREIGN PATENT DOCUMENTS

| | | | |
|---|---|---|---|
| CH | 388531 | A | 2/1965 |
| CN | 205268525 | U | 6/1916 |

(Continued)

OTHER PUBLICATIONS

Translation of CN 212749649. Accessed from Esapacenet on Jul. 18, 2022. (Year: 2021).*

(Continued)

*Primary Examiner* — Valerie L Woodward
*Assistant Examiner* — Paige Kathleen Bugg
(74) *Attorney, Agent, or Firm* — Dawn-Marie Bey; Bey & Cotropia PLLC

(57) ABSTRACT

A percussion massager feature describe herein provides for locking the control display through the touchscreen of the percussion massager to ensure accidental bumps to the display do not disrupt treatment.

13 Claims, 5 Drawing Sheets

(56) References Cited

U.S. PATENT DOCUMENTS 5,085,207 A 2/1992 Fiore
5,134,777 A 8/1992 Meyer
D373,571 S 9/1996 Zambelli
5,656,017 A 8/1997 Keller et al.
5,690,608 A 11/1997 Watanabe et al.
6,228,042 B1 5/2001 Dungan
6,357,125 B1 3/2002 Feldmann et al.
6,616,621 B1 9/2003 Kohr
6,682,496 B1 1/2004 Pivaroff
6,758,826 B2 7/2004 Luettgen et al.
D525,115 S 7/2006 Harwanko
7,122,013 B2 10/2006 Liu
7,144,417 B2 12/2006 Colloca et al.
D544,102 S 6/2007 Pivaroff
D578,080 S 10/2008 Whang
7,503,923 B2 3/2009 Miller
D607,852 S 1/2010 Riede
D632,265 S 2/2011 Choi
D639,784 S 6/2011 Murayama
D649,657 S 11/2011 Petersen et al.
8,083,699 B2 12/2011 Colloca et al.
D662,398 S 6/2012 Jahnke
D679,576 S 4/2013 Paul
8,826,547 B2 9/2014 Oberheim
8,968,221 B2 3/2015 Pryor et al.
D738,355 S 9/2015 Smith
D751,538 S 3/2016 Koehler
D756,333 S 5/2016 Smith
9,526,671 B2 12/2016 Weck et al.
D781,674 S 3/2017 Bullard
9,889,066 B2 2/2018 Danby et al.
D826,205 S 8/2018 Langhammer
D837,395 S 1/2019 Gan
D840,355 S 2/2019 Simon
D848,398 S 5/2019 Huang
D849,260 S 5/2019 Wersland
D850,639 S 6/2019 Wersland
D850,640 S 6/2019 Wersland
10,314,762 B1 6/2019 Marton et al.
10,357,425 B2 7/2019 Wersland et al.
D855,822 S 8/2019 Marton
D857,650 S 8/2019 Hardi
D859,680 S 9/2019 Wersland
D867,342 S 11/2019 Afshar Bakooshli
10,485,731 B2 11/2019 Babiuk
10,492,984 B2 12/2019 Marton et al.
D873,432 S 1/2020 Duan
D874,015 S 1/2020 Marton
10,561,574 B1 2/2020 Marton et al.
D886,317 S 6/2020 Marton
D890,353 S 7/2020 Nazarian
D890,942 S 7/2020 Wersland
D890,943 S 7/2020 Wersland
10,702,448 B2 7/2020 Wersland et al.
D893,738 S 8/2020 Zhuang
D895,133 S 9/2020 Xu
D895,135 S 9/2020 Xu
D895,402 S 9/2020 Hung
D895,828 S 9/2020 Marshall
D895,831 S 9/2020 Chen
D896,393 S 9/2020 Wersland
D898,933 S 10/2020 Xu
D905,863 S 12/2020 Huijuan
D906,533 S 12/2020 Lijun
D907,792 S 1/2021 Marton et al.
D908,235 S 1/2021 Marton et al.
D910,870 S 2/2021 Marton
D917,060 S 4/2021 Hu
D918,404 S 5/2021 Wersland
D918,405 S 5/2021 Wersland
D918,408 S 5/2021 Huang
10,993,874 B1 5/2021 Marton et al.
D920,944 S 6/2021 Paterson
D924,422 S 7/2021 Huang
D927,716 S 8/2021 Wersland
D927,717 S 8/2021 Wersland
D931,492 S 9/2021 Li
D935,403 S 11/2021 Wu
D935,404 S 11/2021 Wu
D938,056 S 12/2021 Wu
D940,892 S 1/2022 Shen
D941,145 S 1/2022 Wang
11,253,423 B1 2/2022 Williams
D949,365 S 4/2022 Li
D949,366 S 4/2022 Li
D949,384 S 4/2022 Liang
D949,417 S 4/2022 Khubani
D949,418 S 4/2022 Khubani
D952,878 S 5/2022 Xiaohong
D958,654 S 7/2022 Lupberger
D959,268 S 8/2022 Hume
D961,107 S 8/2022 Tian
D961,795 S 8/2022 Zhao
D967,971 S 10/2022 Jinfeng
11,478,400 B1 10/2022 Marton
2002/0082532 A1 6/2002 Tucek et al.
2002/0107459 A1 8/2002 Chang
2003/0009116 A1* 1/2003 Luettgen ..... A61H 19/34 601/72
2003/0009118 A1 1/2003 Sabo et al.
2003/0028134 A1 2/2003 Lev
2003/0040689 A1 2/2003 Chan et al.
2003/0101847 A1 6/2003 Harimoto
2003/0195443 A1 10/2003 Miller
2005/0109137 A1 5/2005 Hartmann
2005/0113870 A1 5/2005 Miller
2005/0131461 A1 6/2005 Tucek et al.
2006/0025710 A1 2/2006 Schulz et al.
2006/0293711 A1 12/2006 Keller et al.
2008/0014011 A1 1/2008 Rossen
2008/0183252 A1 7/2008 Khen
2009/0270915 A1 10/2009 Tsai et al.
2010/0137907 A1 6/2010 Tsai
2014/0031866 A1 1/2014 Fuhr et al.
2015/0005682 A1 1/2015 Danby et al.
2015/0107383 A1 4/2015 Duesselberg et al.
2015/0182415 A1 7/2015 Olkowski et al.
2016/0354277 A1 12/2016 Fima
2016/0367425 A1 12/2016 Wersland
2017/0304145 A1 10/2017 Pepe
2018/0008512 A1 1/2018 Goldstein
2018/0168913 A1 6/2018 Sedic
2018/0200141 A1 7/2018 Wersland et al.
2018/0263845 A1 9/2018 Wersland et al.
2018/0320732 A1 11/2018 Kim
2018/0353369 A1 12/2018 Newns et al.
2019/0015294 A1 1/2019 Nazarian et al.
2019/0175434 A1 6/2019 Zhang
2019/0209424 A1 7/2019 Wersland et al.
2019/0232403 A1 8/2019 Candelaria
2019/0254921 A1 8/2019 Marton et al.
2019/0350793 A1 11/2019 Wersland et al.
2020/0046604 A1 2/2020 Danby
2020/0085675 A1 3/2020 Lee et al.
2020/0110526 A1* 4/2020 Ano ..... G06F 3/03542
2020/0170871 A1 6/2020 Lukinuk et al.
2020/0214930 A1 7/2020 Wersland et al.
2020/0261307 A1 8/2020 Wersland et al.
2020/0261310 A1 8/2020 Wersland et al.
2020/0268594 A1 8/2020 Pepe
2020/0276079 A1 9/2020 Cheng
2020/0289365 A1 9/2020 Wersland et al.
2020/0330321 A1 10/2020 Wersland et al.
2020/0352820 A1 11/2020 Nazarian et al.
2020/0352821 A1 11/2020 Wersland et al.
2020/0390644 A1* 12/2020 Yang ..... A61H 23/02
2020/0393026 A1 12/2020 Chang
2020/0405574 A1 12/2020 Wersland et al.
2021/0003168 A1 1/2021 Cong
2021/0022951 A1 1/2021 Hu
2021/0022955 A1 1/2021 Wersland
2021/0059898 A1* 3/2021 Wersland ..... A61H 23/0263
2021/0113421 A1* 4/2021 Chuang ..... A61H 23/006
2021/0128402 A1 5/2021 Dai et al.

(56) References Cited

U.S. PATENT DOCUMENTS

| | | | | |
|---|---|---|---|---|
| 2021/0137779 | A1* | 5/2021 | Ayu | A61H 1/00 |
| 2021/0196562 | A1 | 7/2021 | Zhao | |
| 2021/0244610 | A1* | 8/2021 | Wersland | A61H 15/0085 |
| 2021/0322257 | A1 | 10/2021 | Lee et al. | |
| 2021/0369549 | A1 | 12/2021 | Almodovar | |
| 2022/0096320 | A1 | 3/2022 | Lu | |
| 2022/0154764 | A1 | 5/2022 | Yamashita | |
| 2022/0168175 | A1 | 6/2022 | Tang | |
| 2022/0168176 | A1* | 6/2022 | Coleman | A61H 23/0263 |
| 2022/0168177 | A1 | 6/2022 | Merheller | |
| 2022/0211575 | A1 | 7/2022 | Wersland | |

FOREIGN PATENT DOCUMENTS

| | | | | |
|---|---|---|---|---|
| CN | 206381369 | U | | 8/1917 |
| CN | 208130157 | U | | 11/1918 |
| CN | 2694966 | Y | | 4/2005 |
| CN | 202536467 | U | | 11/2012 |
| CN | 306178047 | | | 11/2020 |
| CN | 212749648 | U | * | 3/2021 |
| CN | 2020305792978 | | | 3/2021 |
| CN | 2021302494257 | | | 8/2021 |
| KR | 102249761 | B1 | | 5/2021 |
| TW | M543692 | U | | 6/1917 |
| TW | M511855 | U | | 11/2015 |
| TW | D207405 | | | 9/2020 |
| WO | WO-2022149067 | A1 | * | 7/2022 |

OTHER PUBLICATIONS

English translation for CH388531, espacenet.com, translated on 7/8/21.

Massage Gun Deep Tissue, Percussion Muscle Massager Gun for Atnletes—Flyby F1 Pro—Handheld Neck & Back Massager for Pain Relief—Therapy and Relaxation Body Massager Gun—Lightweight (Black), [retrieved on Oct. 28, 2021], 9 pp., Retrieved from the Internet: https://www.amazon.com/massage-Gun-Deep-Tissue-Lightweight/dp/B07Y8SRYL3/ref=sr_1_1_sspa?crid=2WY18SO0AT230&dchild=1&keywords=flyby%2Bmassage%2Bgun&qid=1635265651&s=hpc&sprefix=Flyby%2B%2Chpc%2C179&sr=1-1-.

Toloco Massage Gun, upgrade Percussion Muscle Massage Gun tor Athletes, Handheld Deep Tissue Massager Black), [retrieved on Oct. 29, 2021], 10 pp., Retrieved from the Internet: https://www.amazon.com/TOLOCO-massage-Gun-Upgraded-Brushless/dp/B083L8RNJR/ref=sr_1_1 sspa?dchild=1&keywords=Massage%2Bgun&qid=1635272886&sr=8-1 -spons&spLa=ZW5jcnlwdGVkUXVhbGlmaWVyPUFETDEwSENOVDg4SzgmZW5jcnlwdGVkSWQ9QTAyOTUZNTMxN.

Massage Gun Deep Tissue, Muscle Percussion Back Neck Head Handheld Hammer Massager for Athletes, 30 speed evel, LED Touch Screen, Long Battery Life with 10 Heads, [retrieved on Oct. 29, 2021], 9 pp., Retrieved from the Internet: https://www.amazon.com/Massage-Percussion-Handheld-massager-Athletes/dp/B08QJNVP6F/ref=sr_1_4_sspa?dchild=1&keywords=Massage+gun&qid=1635272918&sr=8-4-spons&psc=1&spLa=ZW5jcnlwdGVkUXVhbGlmaWVyPUFKT1dTTDBISUU5TEsmZW5jcnlwdGVkSWQ9QTA3MTI5M.

English translation for CN 212749648 from Espacenet on Jul. 18, 2022 (year 2021).

English translation for KR 102249761, translated by espacenet.com, translated on Oct. 31, 2022.

amazon.com; Massage Gun Massage Gun—Massage Pulse Mini Muscle Massage Gun; Apr. 28, 2022; 2 pgs.

AliExpress.com; Portable Massage Gun Deep Tissue Percussion Muscle Massager for Pain; retrieved on Nov. 22, 2022; 1 pg.

Amazon.com; Mebak 3 Massage Gun Muscle Massager Electric Hand Massager, May 22, 2020; 3 pgs.

Flyby—Massage gun. Date: Aug. 11, 2020. [online]. [Site visited Dec. 1, 2022]. Available from Internet URL: www.youtube.com/watch?v =GYvuNuif8Bc (Year: 2020).

Massage guns. (Design -@Questel) orbit.com. [Online PDF compilation of references selected by examiner] 50 pgs. Print Dates Range Apr. 28, 2020-Mar. 11, 2022 [Retrieved Dec. 2, 2022] https://www.orbit.com/export/UCZAH96B/pdf4/e26b9a3b3-195c-4fbe-87b2- 0eaaf315609e-165234.pdf (Year: 2022).

HP Race Development—Titanium connecting rods. Date: Apr. 30, 2021. [online]. [Site visited Dec. 15, 2022]. Available from Internet URL: https://www.hpracedevelopment.com/news/titanium-connecting-rods-now-available-all-current-250f-models#/ (Year: 2021).

Flyby—Massage Gun Deep Tissue. Date: Nov. 30, 2019. [online]. [Site visited Jul. 20, 2023]. Available from Internet URL: https://www.amazon.com/dp/B07Y8SRYL3/?th=1 (Year: 2019).

Gladiour—Massage Gun Deep Tissue. Date: Jan. 20, 2021. [online]. [Site visited Jul. 20, 2023]. Available from Internet URL: https://www.amazon.com/dp/B08QJNVP6F/ (Year: 2021).

TOLOCO—Massage Gun. Date: Jan. 7, 2020. [online]. [Site visited Jul. 20, 2023]. Available from Internet URL: https://www.amazon.com/dp/B083L8RNJR/ (Year: 2020).

Flyby Massage Gun Deep Tissue. Date: Dec. 30, 2019. [online]. [Site visited May 15, 2023]. Available from Internet URL: https://www.amazon.com/dp/B07Y8SRYL3/?th=1 (Year: 2019).

Gladiour—Massage Gun Handheld Hammer. Date: Jan. 20, 2021 [online]. [Site visited May 15, 2023]. Available from Internet URL: https://www.amazon.com/dp/B08QJNVP6F/ (Year: 2021).

TOLOCO Massage Gun. Date: Jan. 7, 2020. [online]. [Site visited May 15, 2023]. Available from Internet URL: https://www.amazon.com/dp/B083L8RNJR/?th=1 (Year: 2020).

* cited by examiner

SYSTEM AND METHOD FOR LOCKING PERCUSSION SETTINGS ON A MASSAGE DEVICE

CROSS-REFERENCE TO RELATED APPLICATIONS

The following applications and patent are incorporated herein by reference in their entireties: U.S. patent application Ser. No. 17/223,840 entitled PERCUSSIVE MASSAGER ROTATIONAL ACCESSORY, filed Apr. 6, 2021; U.S. patent application Ser. No. 17/229,860 entitled VARIABLE STROKE PERCUSSIVE MASSAGE DEVICE, filed Apr. 13, 2021, now U.S. Pat. No. 11,253,423; U.S. patent application Ser. No. 17/508,954 entitled CONSTRAINED AND REPOSITIONABLE PERCUSSIVE MASSAGE DEVICE TOOL AND TOOL RECEIVER, filed Oct. 22, 2021; U.S. patent application Ser. No. 17/524,732 entitled PERCUSSION MASSAGER HAVING VARIABLE AND SELECTABLE STROKE LENGTH filed Nov. 11, 2021; and U.S. patent application Ser. No. 17/714,140 entitled SELECTABLE, CONFIGURABLE AND INTERCHANGEABLE MASSAGE TOOL HEAD SYSTEM FOR PERCUSSION MASSAGE DEVICES filed Apr. 5, 2022, each of which is commonly owned and list overlapping inventors.

BACKGROUND

Technical Field

The embodiments herein are generally directed to a setting locking feature for a percussion massage device and more particularly to a feature accessible via a touch display of a percussion massage device which facilitates locking (and unlocking) of an established mode of operation.

Description of Related Art

Massage devices are known in the art and present uses include, but are not limited to, pre-work out warm-up or post-activity recovery to increase range of motion and flexibility when administered before sports activity and muscle pliability where massage techniques are applied with a thumb, palm and elbow, used to reduce stress, increase relaxation, reduce pain and muscle soreness and tension. Improving circulation, energy and alertness. Massage devices have also been known to help prevent sore muscles after exercise known as "delayed onset muscle soreness or DOMS. Such massage devices are used in, for example, athletic, physiotherapeutic and chiropractic environments and to a much larger extent now in the home environment.

Massage devices, such as those sold by Applicant, PlayMakar, Inc. are handheld vibratory or percussive massage devices which allow users to quickly adjust settings, e.g., level of percussion and stroke length, with one hand, while still holding the device with the same hand. In newer devices, control features may be incorporated into a touchscreen display, which is susceptible to inadvertent bumps and can suddenly change settings. Such a change, while annoying at the very least, can also cause additional discomfort when the user is already experiencing sensitivity or sore muscles. Further, inadvertent changes in strokes per minute (SPM) could potentially disrupt treatment, cause pain and/or cause poor user experience.

Accordingly, there is a need in the art for a system and method that ensures accidental bumps do not alter settings on a massage device.

SUMMARY OF THE EMBODIMENTS

In a first non-limiting embodiment, a process for selecting and locking user settings of a percussion massage device includes: powering on the percussion massage device; selecting via a touchscreen display of the percussion massage device a percussion mode from a range of percussion modes, and locking the touchscreen display to lock in the selected percussion mode, wherein locking includes pressing at least a first icon on the touchscreen display for a predetermined amount of time.

In a second non-limiting embodiment, a handheld percussion massage device comprising: a power switch; and a touchscreen for facilitating user selection of massage settings, the touchscreen including a first icon and a second icon for facilitating (i) user selection of a strokes-per-minute value and (ii) locking and unlocking the touchscreen to lock-in or unlock the massage settings.

BRIEF DESCRIPTION OF DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1A:
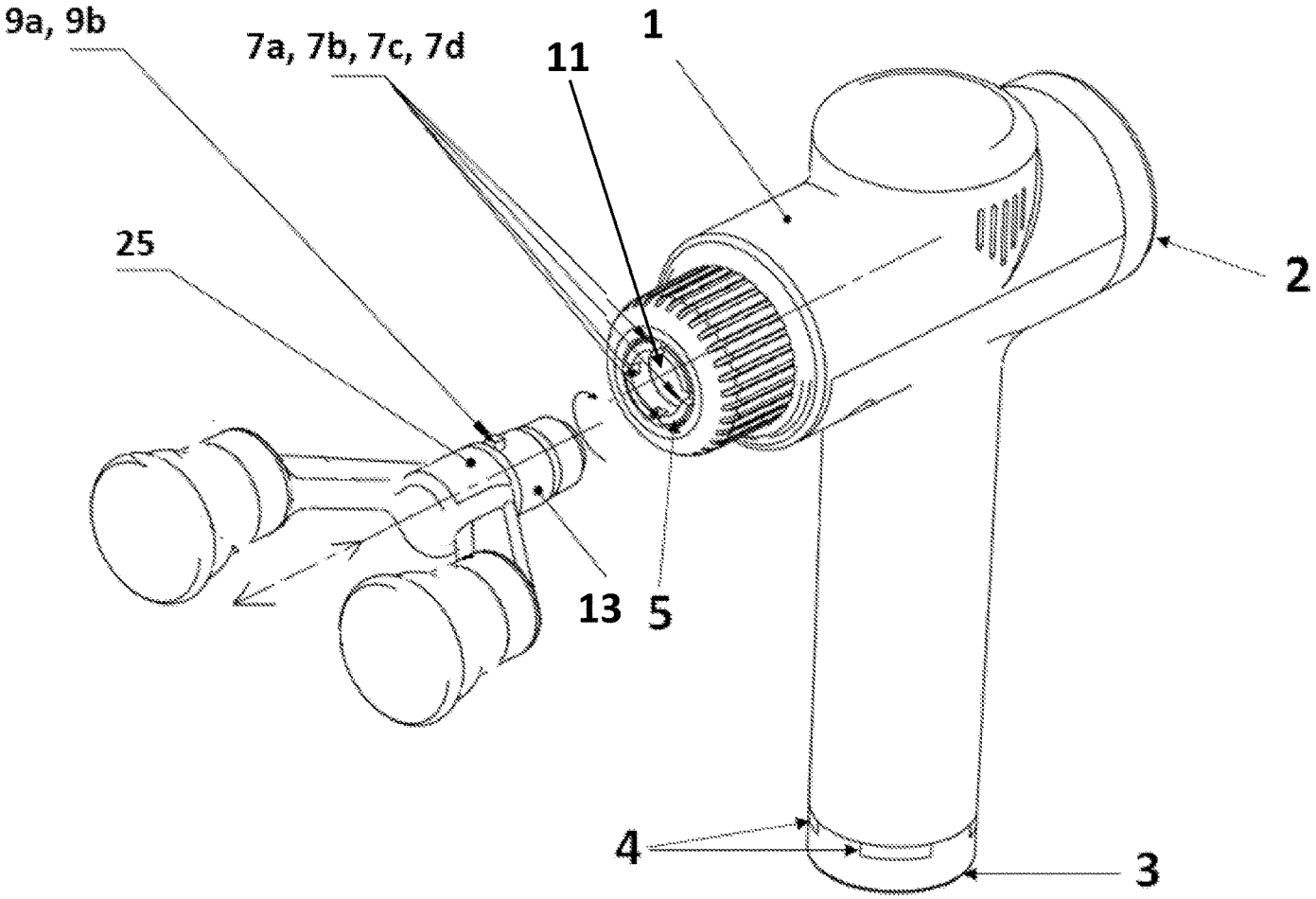
FIGS. 1*a*, 1*b*, 1*c* and 1*d* illustrate a percussion massage device having a touchscreen in accordance with the preferred embodiment described herein.
Figure 1B:
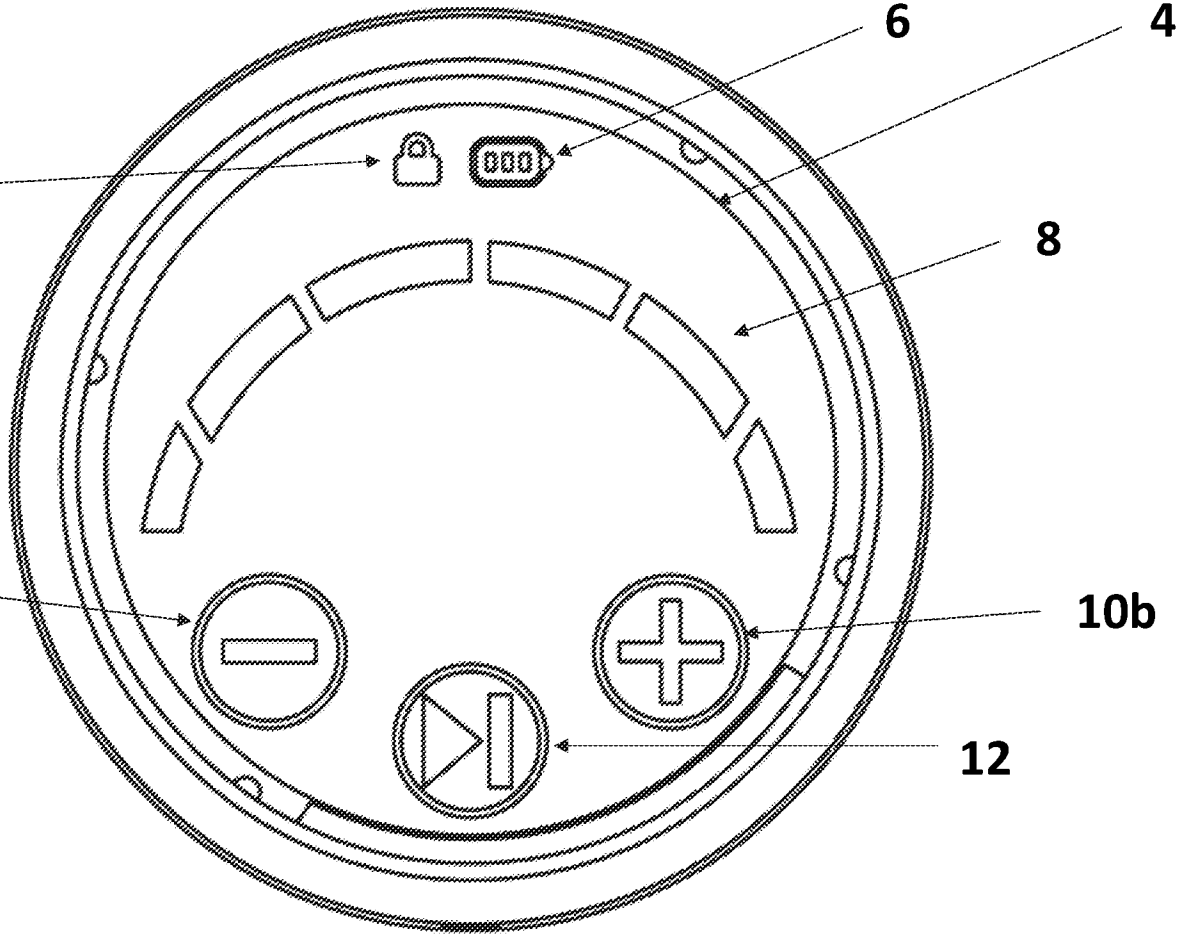
Figure 1C:
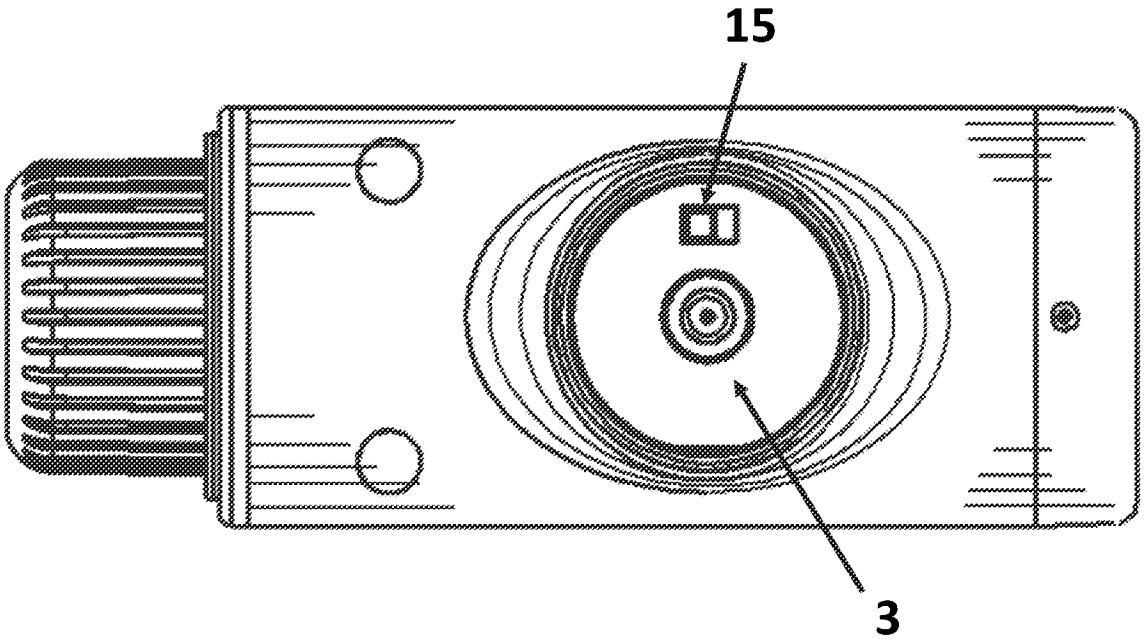
Figure 1D:
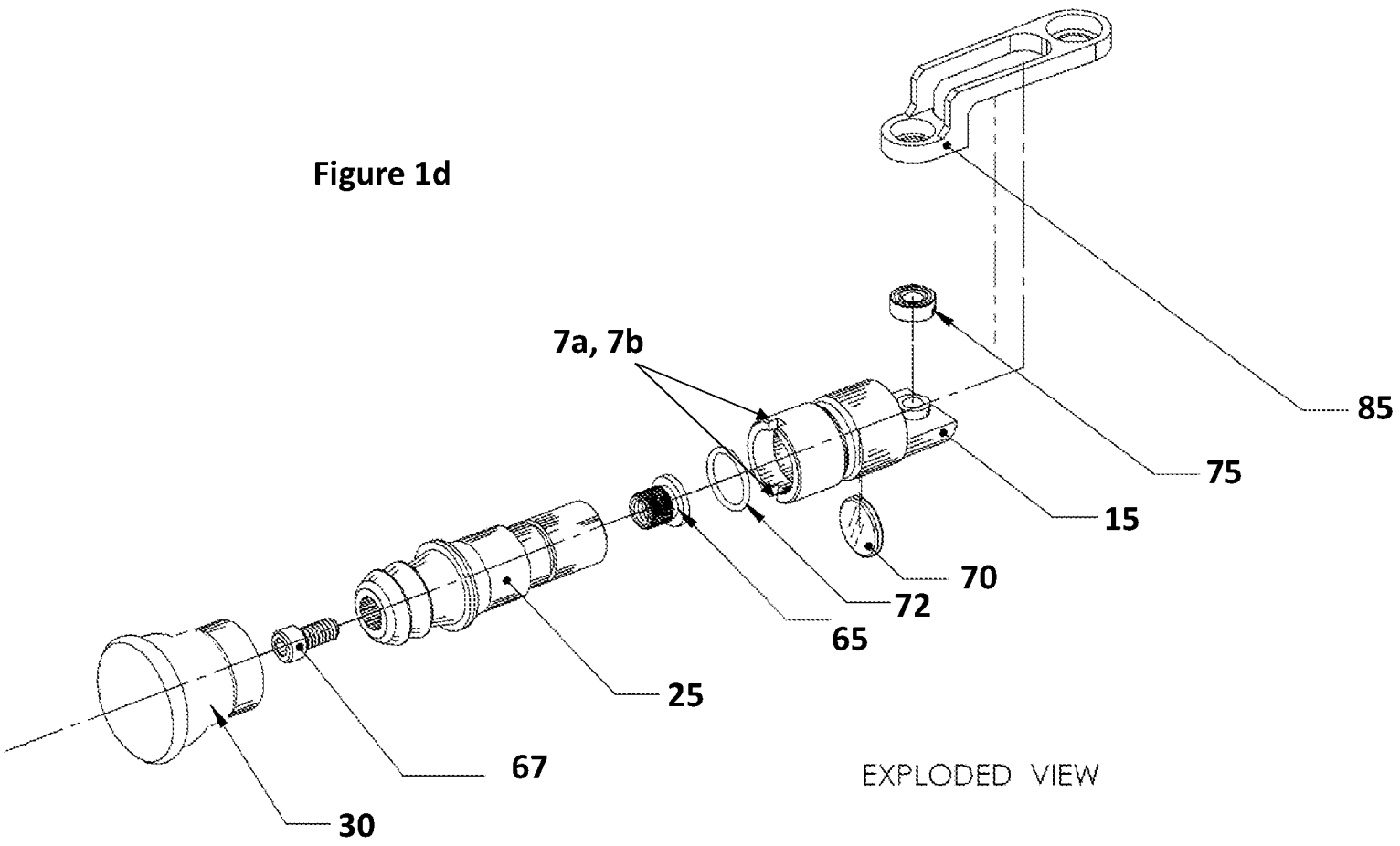

FIGS. 1*a*, 1*b*, 1*c* and 1*d* illustrate an exemplary percussion massage device 1 which may incorporate the screen locking feature described further herein. The device 1 includes: touchscreen display 2, base 3 which incorporates transparent windows 4 around and within a circumference thereof and a tool holder 5. The percussion massage device 1 of FIG. 1*a* receives a massage tool 10 described in at least U.S. Pat. No. 11,253,423 and Ser. No. 17/714,140), which may be one of various configurations, in the tool holder 5 thereof. The percussion massage device 1 of FIG. 1*a* facilitates attachment/de-attachment of tool heads to/from tool holder 5 in accordance with a key and keyway (see key ways 7*a*, 7*b*, 7*c*, 7*d* in FIG. 1*a*) attachment system. The embodiments are not so limited. For example, a magnetic attachment system described in U.S. application Ser. No. 17/508,954 may also be used as shown in FIG. 1*d*. The alternative attachment system is a magnetic attachment component wherein a shaft 25 of the tool includes an insert 65 which is formed of a material that will be attracted to a magnet 70, located in the tool receiver 15 when brought into proximity thereof. An O-ring 72 is included to mitigate vibration between tool receiver 15 and shaft 25. A massage tool further includes at least one removable and exchangeable tip 30 which includes a tip stiffener, e.g., fastener, e.g., screw, 67, which may be used to adjust impact for stiffness dampening during use of the massaging device. Screw 67 is fastened within the shaft of 25. The percussive motion imparted to the tool 10 is facilitated by connection of the tool receiver 15 to a crank 85 via bearing 75 located within the massage device 1. The screw 67 provides a user with the ability to adjust the hardness of the tool heads.

Referring to FIG. 1*b*, touchscreen display 2 (of device 1 in FIG. 1*a*), provides status indicators (or icons), e.g., battery charge level 6, percussion level 8, as well as mechanisms 10*a* (–), 10*b* (+) for facilitating user adjustment down(–)/up(+) of SPM and a selection mechanism for facilitating user selection of a preferred stroke length from two available stroke lengths (short or long) by reversing direction of the motor rotation 12 (pause/play button). Additionally, a lock indicator icon 14 is included to indicate when the present setting have been locked in in accordance with the steps described herein. Each of the touchscreen features includes light up functionality enabled by LED components which may include single or multiple colors in accordance with desired indicators. Both the battery charge level 6 and percussion level 8 indicators include multiple windows which are illuminated or not illuminated in accordance with the level of charge and the level of percussion, i.e., strokes-per-minute, respectively.

In a preferred embodiment, a user first turns on the percussion massager using a slide switch 15 which may be located on the bottom of base 3 of the device 1 as shown in bottom view FIG. 1*c*. Alternatively, the power may be turned on/off by pressing an icon on the touchscreen. The touchscreen display and power indicator lights will turn on. The user selects desired settings using the touchscreen display e.g., SPM Level using mechanisms (e.g., keys) 10*a* (–), 10*b* (+) and/or stroke length (short or long) or to reverse direction of the motor rotation using 12. In order to lock in these settings, the user may lock the touch screen by hold down both 10*a* (–) and 10*b* (+) keys simultaneously for a predetermined amount of time, e.g., 3 seconds. This will cause the lock indicator icon 14 to appear lit on the display, confirming that the screen is locked. To unlock the touchscreen, hold down both 10*a* (–) and 10*b* (+) keys for the same predetermined amount of time, e.g., 3 seconds. If the screen is in locked mode when the user powers off the device, the lock function is disabled upon powering down.

Figure 2:
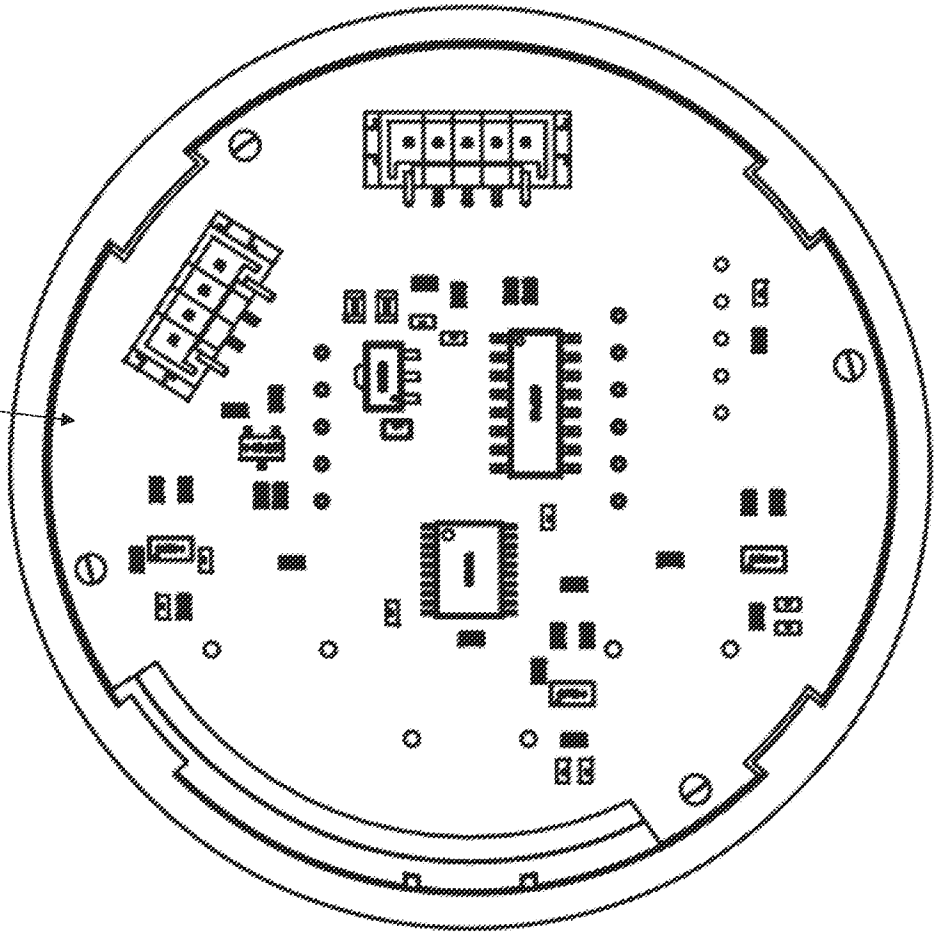
FIG. 2 illustrates an exemplary controller board for the touchscreen of the percussion massage device in accordance with the preferred embodiment described herein.

As shown in FIG. 2, to implement the touchscreen display 4 with various selection and locking features described herein, touchscreen 4 includes a controller board 20 which includes various microelectronic components thereon. One skilled in the art will recognize the numerous configurations and technologies which may be used including, but not limited to: printed circuit boards, surface-mount technology, microcontrollers, capacitors, digital signal processors (DSPs), electrodes, light emitting diodes (LEDs). The touchscreen may be resistive or capacitive.

The embodiment set forth above is exemplary. Unless otherwise defined, all technical and scientific terms used herein have the same meaning as commonly understood by one of ordinary skill in the art to which the embodiment belongs. The massage device with screen locking feature may be embodied in other specific forms without departing from the spirit or essential attributes thereof, and it is therefore desired that the present embodiment be considered in all respects as illustrative and not restrictive.

The invention claimed is:

1. A handheld percussion massage device including a user selection locking mechanism to avoid accidental bumping and inadvertently causing the user discomfort during use of the device, the device comprising:

a tool receiver for receiving a massage tool therein, the tool receiver including a piston for providing percussive action to the massage tool;

the massage tool, including a hollow attachment post at a first end thereof for insertion into the tool receiver and selectively attaching to the tool receiver and engaging with the piston, wherein the tool receiver includes one or more keyways and the hollow attachment post includes one or more keys for engaging with at least one of the one or more keyways to secure the massage tool to the tool receiver and engage with the piston to facilitate the piston providing percussive action along a longitudinal axis of the hollow attachment post, and further wherein the massage tool, including hollow attachment post, is removable from the tool receiver;

the massage tool further including at least one interchangeable tool head tip attached to at least one second end of the hollow attachment post, the at least one interchangeable tool head tip being removable from the massage tool, wherein the massage tool includes an adjustment means for adjusting a hardness of each at least one interchangeable tool head tip;

a power switch; and a touchscreen for facilitating user selection of massage settings, the touchscreen including a first icon and a second icon for facilitating (i) user selection of a strokes-per-minute value of the piston and (ii) locking and unlocking the touchscreen to lock-in or unlock the massage settings.

2. The handheld percussion massage device of claim 1, wherein pressing the first icon reduces the strokes-per-minute value and pressing the second icon increases the strokes-per-minute value.

3. The handheld percussion massage device of claim 1, further comprising a third icon for facilitating user selection of a stroke length.

4. The handheld percussion massage device of claim 1, wherein pressing the first icon and second icon simultaneously for a predetermined amount of time will lock or unlock the touchscreen.

5. The handheld percussion massage device of claim 4, wherein the predetermined amount of time is 3 seconds.

6. The handheld percussion massage device of claim 3, wherein each stroke length selection is indicated by a different illuminated color of the third icon.

7. A handheld percussion massage device including a user selection locking mechanism to avoid accidental bumping and inadvertently causing the user discomfort during use of the device, the device comprising:

a power switch; and a touchscreen for facilitating user selection of massage settings, the touchscreen including a first icon and a second icon for facilitating (i) user selection of a strokes-per-minute value of a piston and (ii) locking and unlocking the touchscreen to lock-in or unlock the massage settings;

a tool holder for receiving a massage tool therein, the tool holder including the piston for providing percussive action to the massage tool; and the massage tool, including an attachment post at a first end thereof for insertion into the tool holder and selectively attaching to the tool holder and engaging with the piston, wherein the tool holder includes multiple keyways and the attachment post includes multiple keys for engaging with at least some of the keyways to secure the massage tool to the tool holder, and further wherein the massage tool, including attachment post, is removable from the tool holder;

the massage tool further including at least one removable and interchangeable tool head tip attached thereto, wherein the massage tool includes an adjustment means for adjusting a hardness of each at least one interchangeable tool head tip.

8. The handheld percussion massage device of claim 7, wherein pressing the first icon reduces the strokes-per-minute value and pressing the second icon increases the strokes-per-minute value.

9. The handheld percussion massage device of claim 7, further comprising a third icon for facilitating user selection of a stroke length.

10. The handheld percussion massage device of claim 7, wherein pressing the first icon and second icon simultaneously for a predetermined amount of time will lock or unlock the touchscreen.

11. The handheld percussion massage device of claim 10, wherein the predetermined amount of time is 3 seconds.

12. The handheld percussion massage device of claim 9, wherein each stroke length selection is indicated by a different illuminated color of the third icon.

13. The handheld percussion massage device of claim 7, wherein the massage tool includes a hollow attachment shaft attached to the tool holder at a first end and attached to at least one removable and interchangeable tool head tip at a second end.

* * * * *